US006561952B2

(12) United States Patent
Wu

(10) Patent No.: US 6,561,952 B2
(45) Date of Patent: May 13, 2003

(54) TURNING CONTROL DEVICE FOR A VIRTUAL STATIONARY BIKE

(75) Inventor: Mu-Chuan Wu, Tainan Hsien (TW)

(73) Assignee: Tonic Fitness Technology, Inc., Tainan Hsien (TW)

( * ) Notice: Subject to any disclaimer, the term of this patent is extended or adjusted under 35 U.S.C. 154(b) by 189 days.

(21) Appl. No.: 09/747,836

(22) Filed: Dec. 27, 2000

(65) Prior Publication Data

US 2002/0082147 A1 Jun. 27, 2002

(51) Int. Cl.[7] ..... A63B 69/16; G09B 9/04

(52) U.S. Cl. ..... 482/3; 482/57; 482/8; 482/901; 434/61

(58) Field of Search ..... 482/51, 57, 1–8, 482/9, 10, 900–902; 434/29, 61; 273/148 B; 463/37

(56) References Cited

U.S. PATENT DOCUMENTS 4,512,567 A * 4/1985 Phillips ..... 482/57
5,240,417 A * 8/1993 Smithson et al. ..... 482/57
5,362,069 A * 11/1994 Hall-tipping ..... 482/901

* cited by examiner

*Primary Examiner*—Stephen R. Crow
(74) *Attorney, Agent, or Firm*—Pro-Techtor International Services

(57) ABSTRACT

A turning control device for a virtual stationary bike includes a video monitor and a computer program. The program is driven by a flywheel of the bike to show images of a rider on the bike on a road. A control case is fixed at the lower end of the handle with a sensor fixed inside for sending signals, with a shade plate that moves with the handle. The shade plate is positioned between two circuit boards, and has a plurality of opening for controlling lights emitted by electronic elements of the two circuit boards. The handle Controls the shade and the sensor to send out different signals so that the video monitor shows images of the rider on the bike moving in directions according to the command of the computer program, permitting the rider to feel as though he were riding on a road to enhance the pleasure of exercise.

7 Claims, 7 Drawing Sheets

TURNING CONTROL DEVICE FOR A VIRTUAL STATIONARY BIKE

BACKGROUND OF THE INVENTION

This inventionrelates to a turning control device for a virtual stationary bike, particularly to one having a handle controlling a video monitor to show a rider on the bike changing his position so that the rider feels as if he was riding a real bike on a road, thereby enhancing the pleasure of exercise.

A traditional stationary bike generally includes a bike frame, a handle, a seat, a pedal, and a flywheel for a user to pedal for exercise. The user only looks forward monotonously. So a conventional virtual stationary bike includes a video monitor positioned in a front portion of a bike, and a computer program provided to display images on the video monitor. A flywheel drives the computer program. The video monitor shows images of a rider on the bike on a road, with scenes changing according to the programmed design. When the fly wheel begins to rotate, the monitor may show the scenes moving toward the rider on the bike, and it seems as through the rider on the bike were running forward virtually on a road. This lets the user feel pleasant.

SUMMARY OF THE INVENTION

The objective of the invention is to offer a turning control device for a virtual stationary bike, permitting a user of the stationary bike to feel as if he is riding a bike, enhancing the pleasure of exercise.

The novel feature of the invention is a control case fixed at a lower end of a handle. A sensor contained in the control case has an output terminal connected to a computer program so that the handle controls the computer program. The computer program is connected to a video monitor positioned so that it can be seen by a user. The monitor show images of a rider on a bike on a road, the images changing according to signals sent from the computer program activated by the handle. The handle has a transmitting rod fixed at a lower end of an inner rod of the handle that is inserted into the control base and connected to the sensor. Turning the handle activates the sensor and sends out different output signals according to turning modes of the handles. The signals are sent to the computer program, and the monitor show the changing images.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
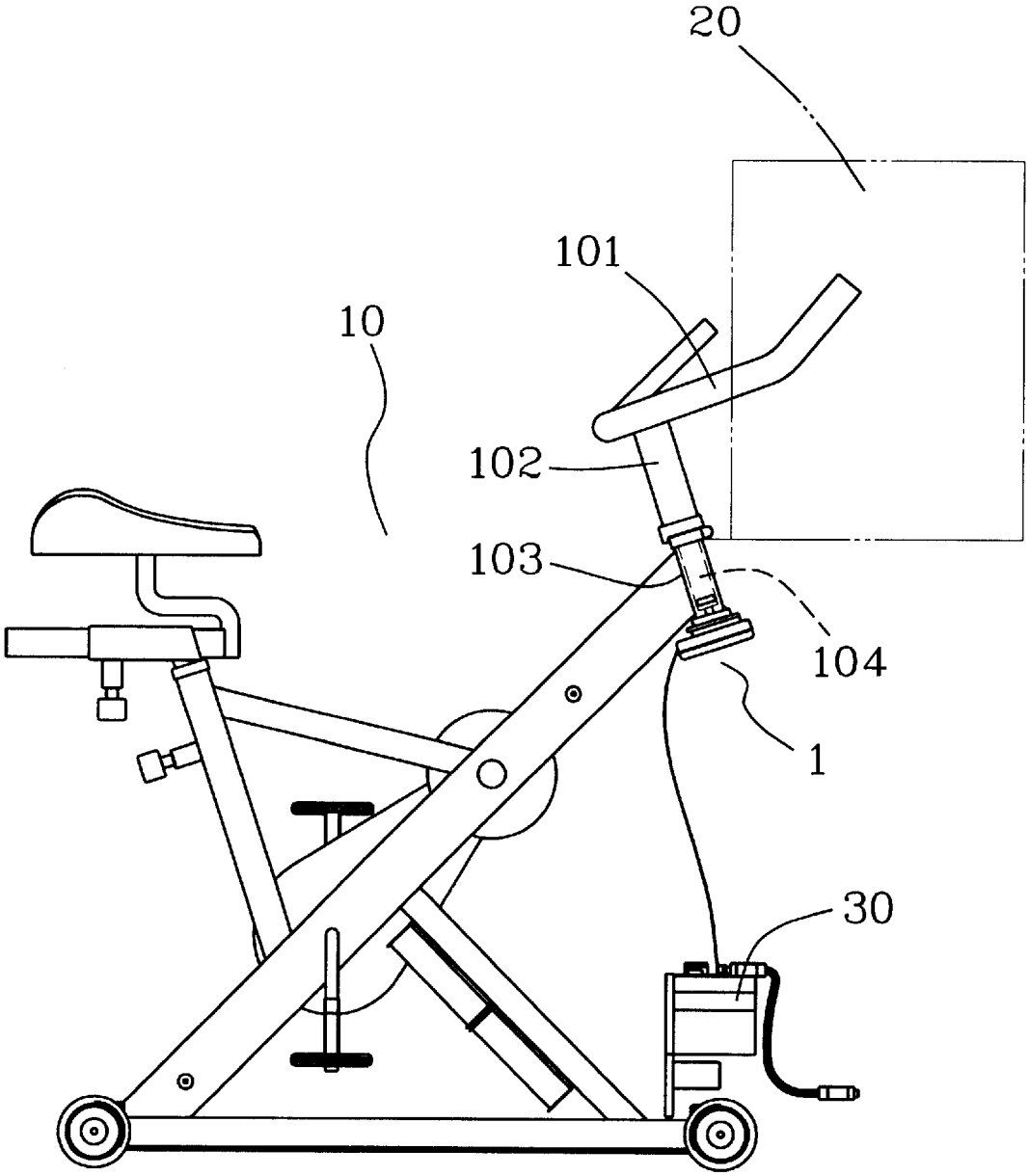
FIG. 1 is a side view of a virtual stationary bike provide with a turning control device of the present invention.
Figure 2:
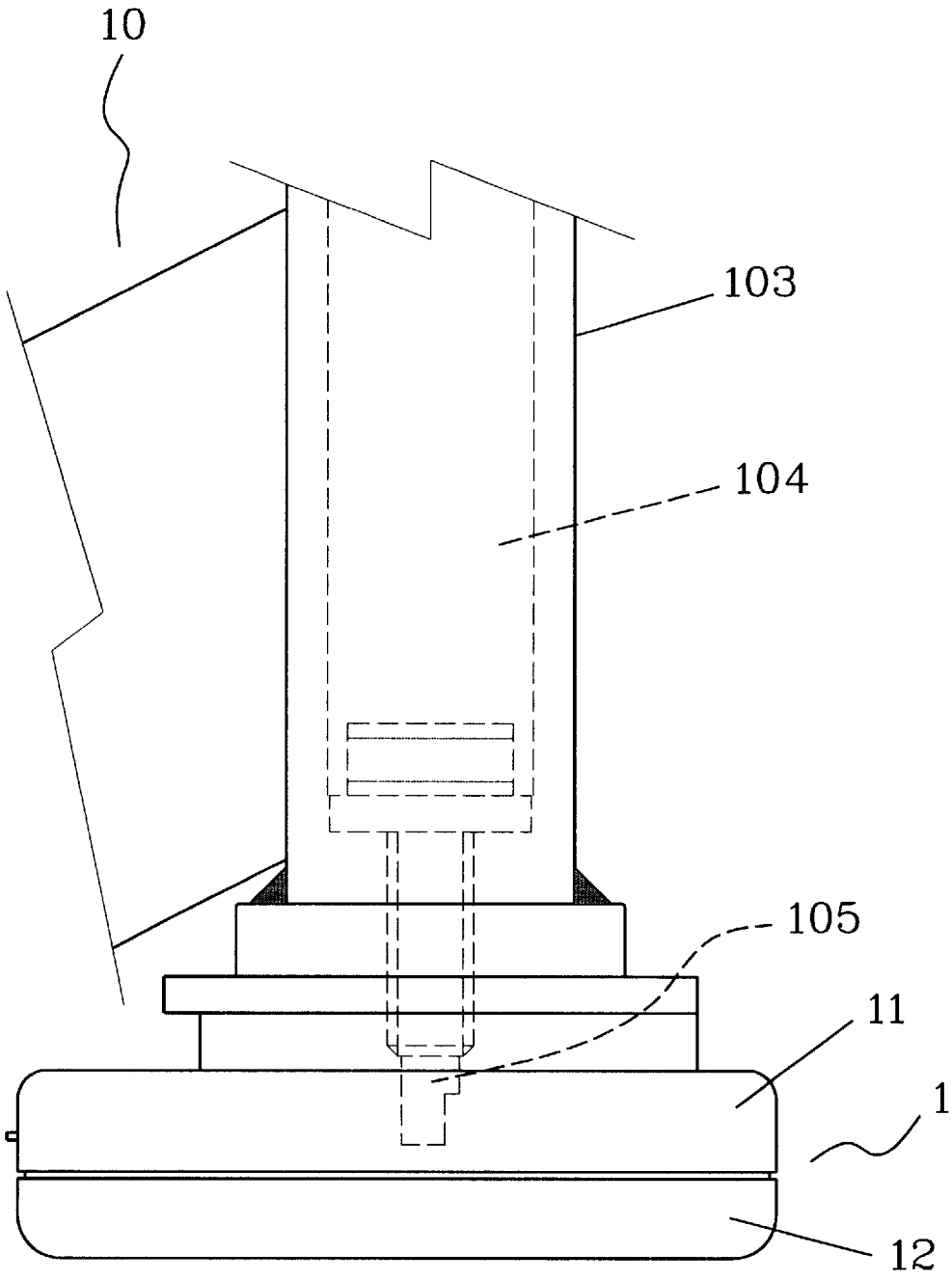
FIG. 2 is a partial enlarged view of FIG. 1.

A preferred embodiment of a turning control device for a virtual stationary bike according to the present invention is shown in FIGS. 1 and 2. The device includes a bike body 10, a video monitor 20, and a computer 30 having a program. In this description the computer is independent, but the program can be set in the bike body or in the video monitor 20. The program is driven by a flywheel of the bike body 10 so that the video monitor 20 can show the image of a rider on the bike moving on a road.

The bike body 10 includes a movable handle 101 having a vertical rod 102. The lower end of the vertical rod 102 is formed as an inner rod 104 fitting in a front cylinder 103 of the bike body 10. The rod 102 is turned by the handle 101. Further, a transmitting rod 105 is provided to extend downward from the lower end of the inner rod 104 as show in FIGS. 3 and 4.

The lower end of the front cylinder 103 is attached to an upper cover 11 of a control case 1. The case 1 comprises the upper cover 11 and a bottom cover 12. The upper cover 11 has a center hole 111 to receive the transmitting rod 105.

Figure 3:
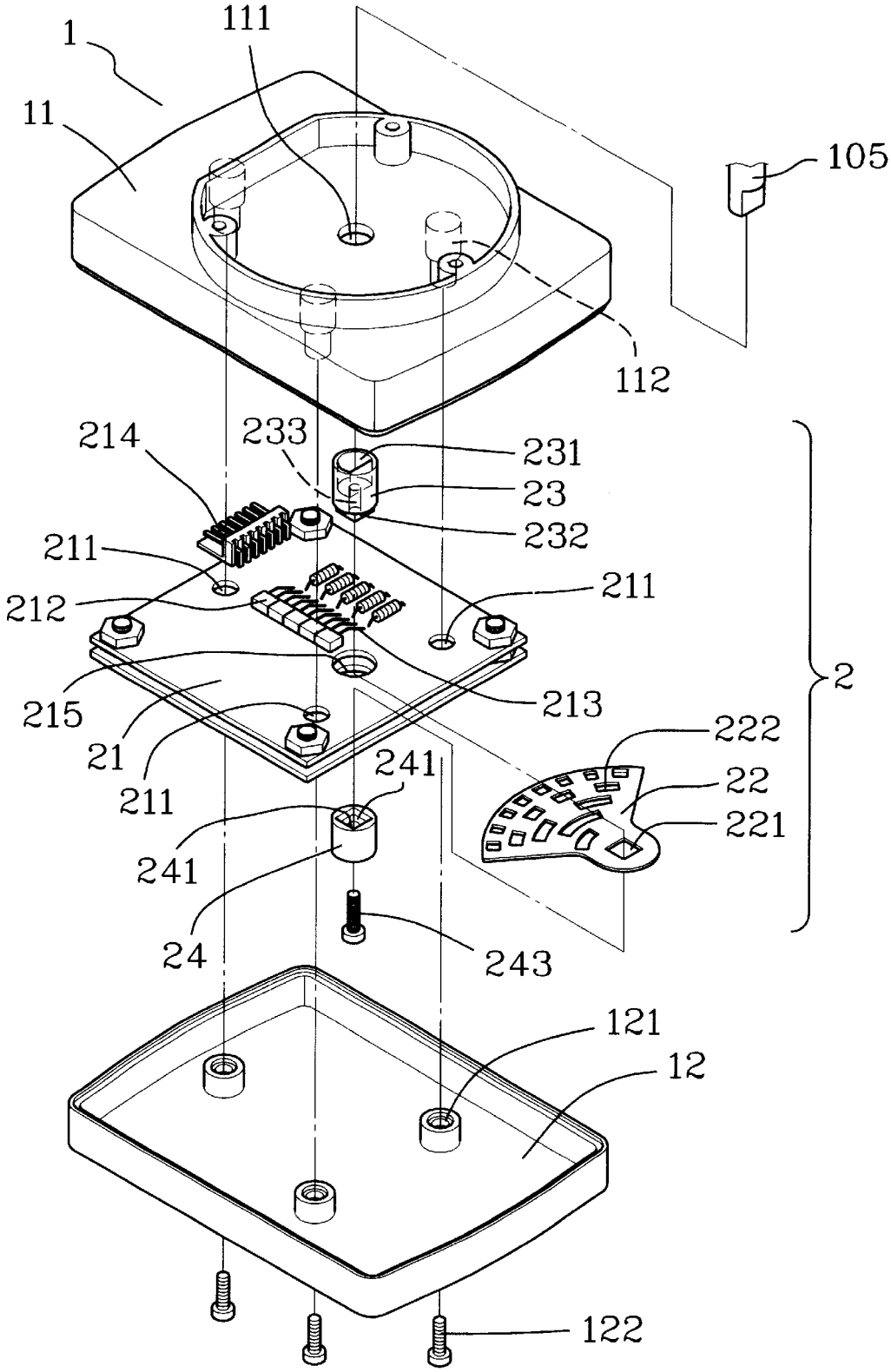
FIG. 3 is a an exploded perspective view of a control base and a sensor in the present invention.
Figure 4:
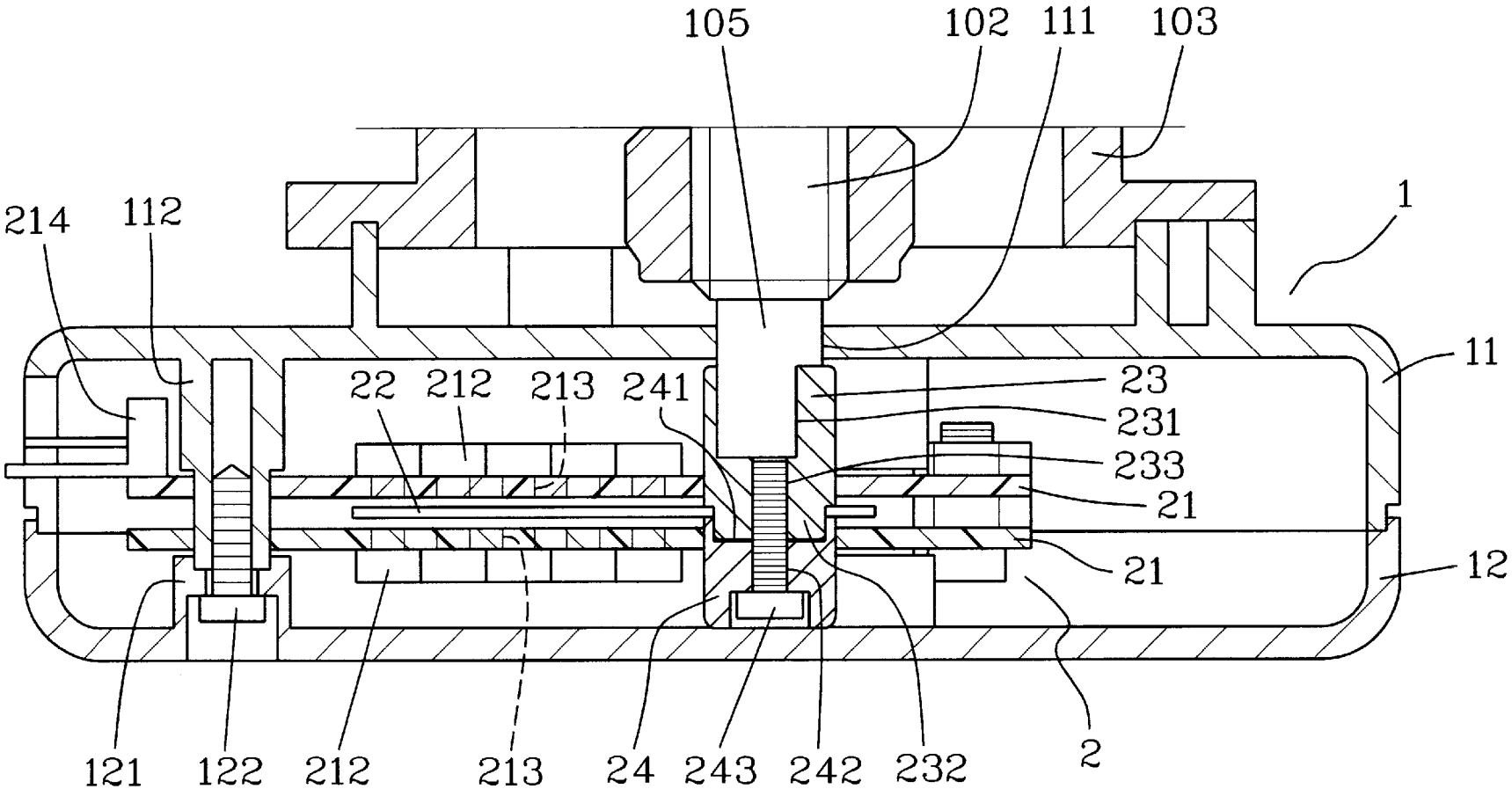
FIG. 4 is a cross-sectional view of a turning control device for a virtual stationary bike in the present invention.

The control case 1, as shown in FIGS. 3 and 4, has an output terminal 214 connected to the sensor 2 of the computer 30. The upper cover 11 has a plurality of screw receivers 12 for attachment to the bottom cover 12, which is provided with plural support rings 121 for screw 122 to pass through.

The sensor 2 consists of two—one an upper and the other a lower—circuit boards 21 with a gap between the two circuit boards 21. A plurality of light emitting electronic elements 212 are fixed on a upper surface of the upper circuit board and on a lower surface of the lower circuit board.

The output terminal 214 extends out of the control case 1 from one of the circuit boards 21 to transmit a signal from the electronic elements 212. Further, a hole 215 is bored through the two circuit boards 21, and a fan-shaped plate 22 is placed between the two circuit boards 21.

Figure 6:
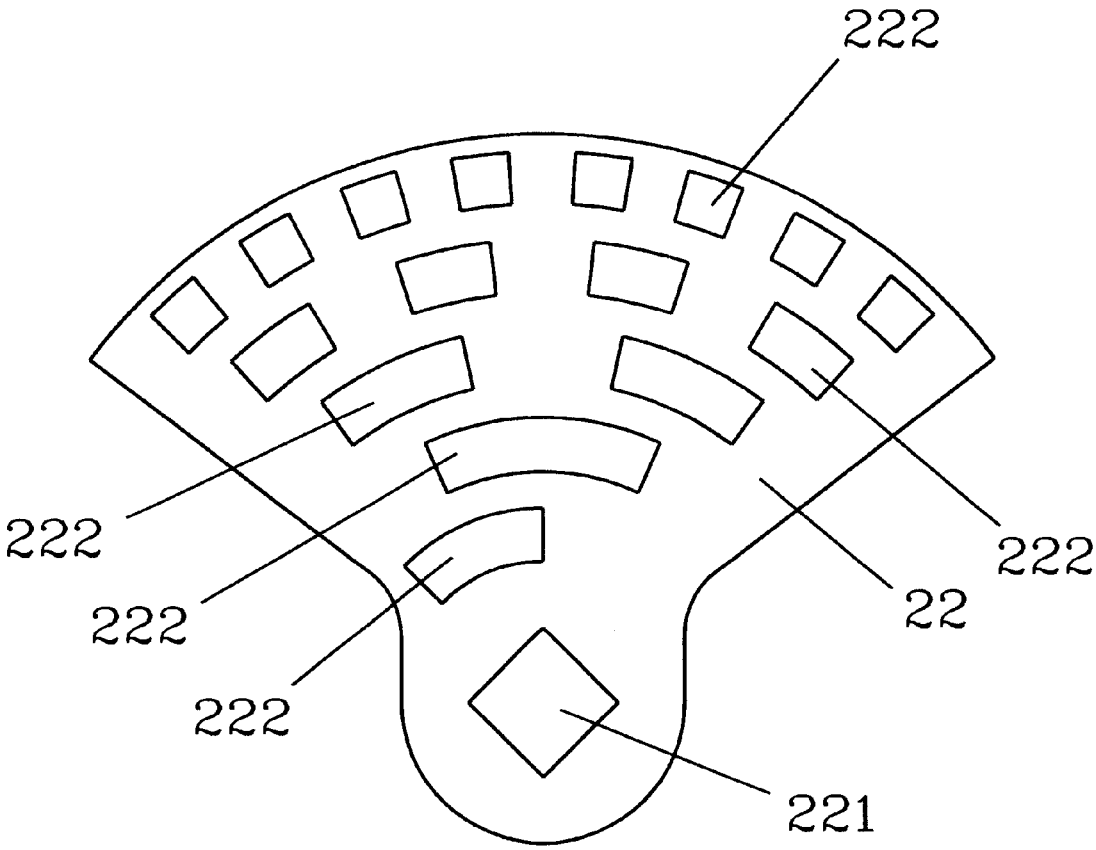
FIG. 6 is an upper view of a shade plate of the sensor of the present invention.

Now also referring to FIG. 6, a hole 221 is bored in the shade plate 22 and aligned with the holes 215 in the two circuit boards 21. The holes 215, 221 receive a connecting post 23. The connecting post 23 has a recess 231 formed in an upper surface to conform to the shape of the transmitting rod 105. A block 232 has a threaded hole 233 formed in a lower end thereof. Further, a short round post 24 is inserted into the hole 215 of the lower circuit board 21. The post 24 has an insert recess 241 (with the same shape as the insert block 232) on an upper surface and a through hole 242 aligned to the threaded hole 233 of the connecting post 23.

Figure 5:
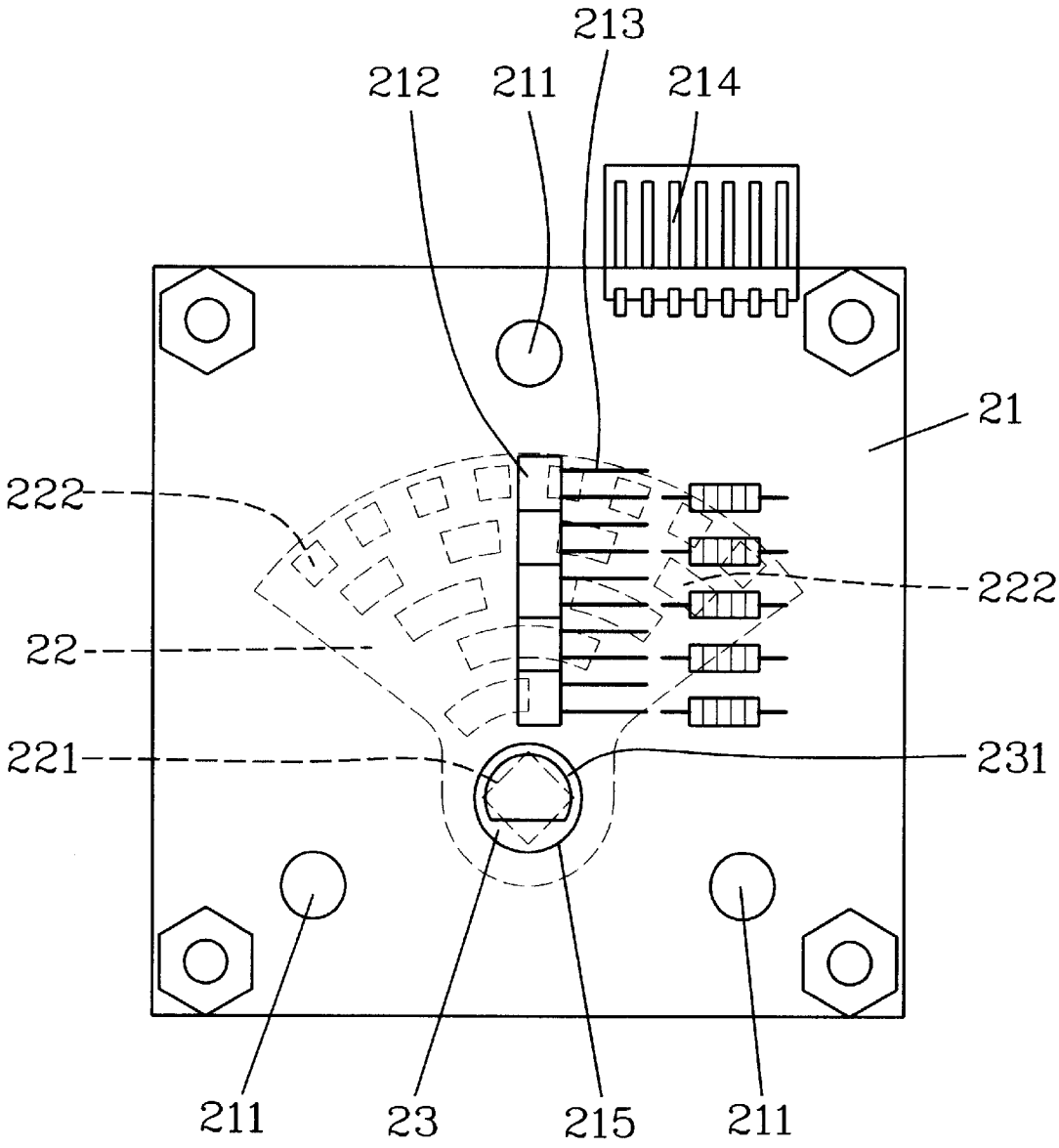
FIG. 5 is an upper view of the turning control device in operation.

The fan-shaped shade plate 22 has a plurality of non-circular opening 222 of different sizes arranged in several concentric circles in the fan-shaped portion of the shade plate 22, as shown in FIG. 5. There are 16 openings 222 illustrated in this embodiment.

Assembly of the control case 1 and the sensor 2 is shown in FIG. 4, with the shade plate 22 positioned between the upper and the lower circuit board 21, and with the hole 221 aligned with the hole 215 of the two circuit boards 21. The fan-shaped shade plate 22 is positioned to face toward the electronic elements 212, and the connecting post 23 is inserted through the hole 215 of the circuit boards 21 from above, with the block 232 passing through the hole 221 of the shade plate 22. Then the short round post 24 is inserted through the hole 215 of the lower circuit board 21 with the block 232 of the connecting post 23 fitting in a hole 241 in the short round post 24. Finally, a screw 243 passes through the through hole 242 of the short round post 24, screwing into a the screw hole 233 of the connecting post 23, with the shade plate 22 clasped between the connecting post 23 and the short round post 24, and also between the upper and the lower circuit boards 21. The shade plate 22 has its upper and lower sides out of contact with the upper and lower lower circuit boards 21.

Next, the sensor 2 is placed on the bottom cover 12 of the control case 1, with the round hole 211 of the circuit boards 21 aligned with the support rings 121 on the lower cover 12. The upper cover 11 is closed on the lower cover 12 with the screw receivers 112 passing through the holes 211 of the two circuit boards 21, and being aligned with the support rings 121 of the lower cover 12. The screws 122 pass through the support rings 121 and screw to the screw receivers 112 of the upper cover 11, firmly fixing the sensor 2 in the control case 1, with the insert hole 231 of the insert connect post 23 of the sensor 2 aligned with the center insert hole 111 of the upper cover 11.

Next, as shown in FIG. 4, the control case 1 is fixed to a lower end of the cylinder 103, in which the inner rod 104 of the vertical rod 102 of the handle 101 is inserted. The transmitting rod 105 is inserted into the center hole 111 of the upper cover 11, and also into the hole 231 of the connecting post 23. The output terminal 214 of the sensor 2 is connected to the computer 30 to send signals emitted by the electronic element 212 to the computer 30. Consequently, when the handle 101 of the stationary bike 10 is turned right or left, the transmitting rod 105 is rotated together with the insert connect rod 23 and the short round post 24, and the fan-shaped shade plate 22 rotates eccentrically between the two circuit boards 21. The arc of rotation of the shade plate 22 is restricted between two of the screw receivers 112, as shown in FIG. 5.

Therefore, in using the stationary bike 10, the flywheel activates the video monitor showing an image of a user on the bike moving ahead on a road. The user may move the handle 101 in the same direction of the winding road, with the fan-shaped portion of the shade plate 22 moving synchronously with the handle 101. Then the lights emitted by the upper and the lower electronic elements 212 pass through the openings 222 of the shade plate 22, forming a signal (corresponding to the location of the lights of the electronic elements 121 being shaded).

When the computer program receives different signals, the location of the image of the user and the bike on the road on the video monitor moves according to the signal. A user can change the location of himself and the bike at any time, as if the user were riding on a bike. This eliminates the monotonous feeling of the conventional computer program of the conventional stationary bike.

Figure 7:
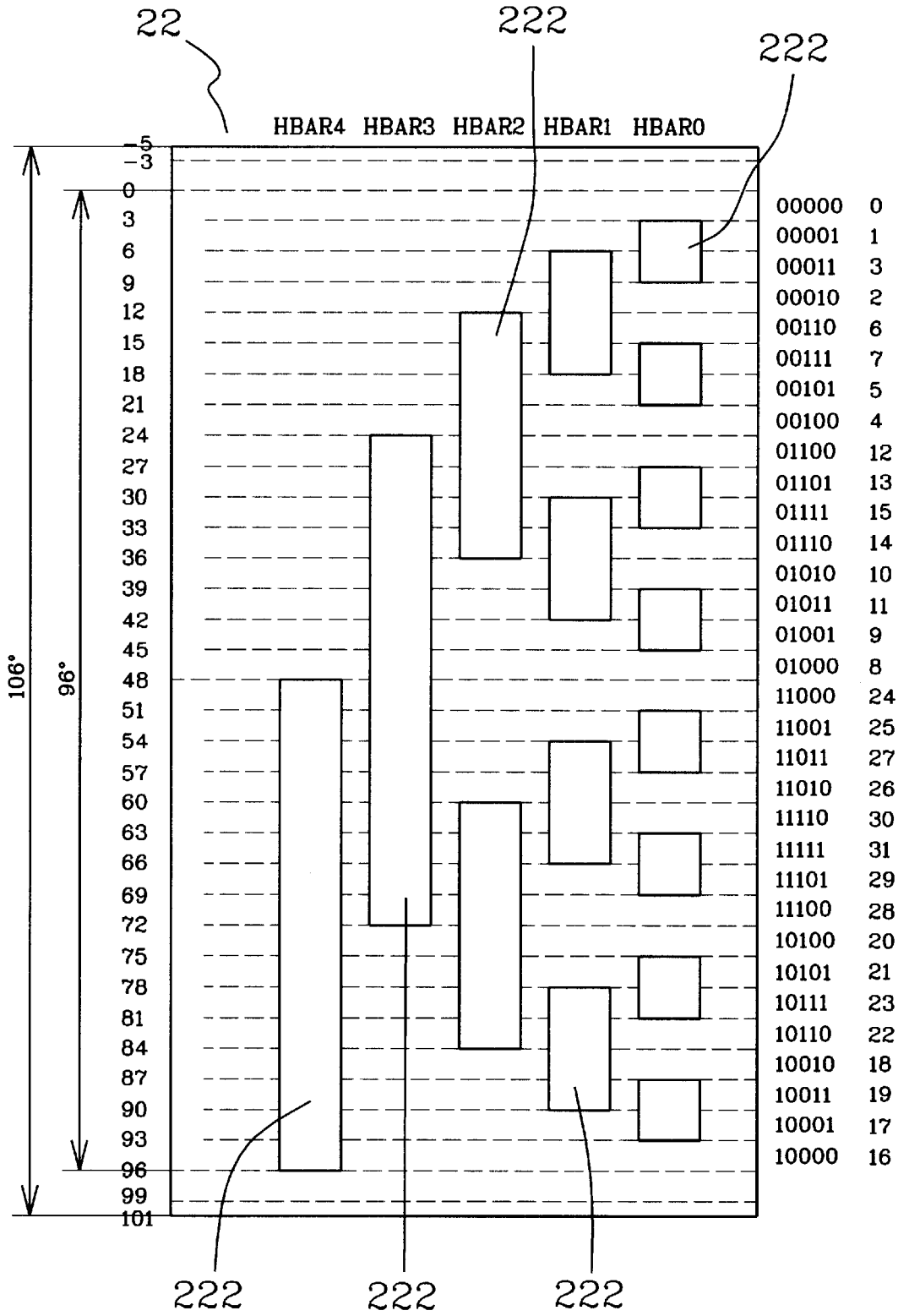
FIG. 7 is an operating diagram of the shade plate in the present invention.

As for the design of the shade plate 22, as shown in FIGS. 6 and 7, its angle, its size, and the positions are minutely calculated and arranged according to the coding mode of Fray. As shown in FIG. 7, the operating diagram of the shade plate 22, rotation of the shade plate 22 can produce 0–31 modes of the five openings 222, 32 modes in total. In other words, the rotation of the shade plate 22 in shading the lights emitted by the electronic elements 212 can produce 32 different signals to be sent to the computer program to let the image of the use and the bike on a road on the video monitor change in 32 different ways. In order to let every mode have a buffer area, every mode value is set at 3 degrees, 96 degrees in total, with the angle between the outer edge of the outermost opening 222 and the center-line being 96 degrees. The shade plate 22 has an arc of 106 degrees. However, these values may change according to different designs.

The invention has the following advantages, as can e understood from the aforesaid description.

1. A user can utilize movement of the handle 101 to change the image of the user and the bike on a road on the video monitor.

2. The sensor makes use of signal lights emitted by the electronic elements 212, which have no contact points so that there is no resistance change or mechanical wear, and the device is not affected by voltage change. The shade plate 122 has the openings 222 arranged by using Fray's code so that interrupted codes or double codes do not occur.

3. The casing components of the device can be injection molded.

While the preferred embodiment of the invention has been described above, it will be recognized and understood that various modifications may be made therin and the appended claims are intended to cover all such modifications that may fall within the spirit and the scope of the invention.

I claim:

1. A turning control device for a virtual stationary bike comprising:

a video monitor, a computer program, and a bike body with a steering handle; wherein a control case is situated at a lower end of said handle, and a sensor contained in said control case has an output terminal connected to said computer program so that said handle controls said computer program, said computer program is connected to a video monitor positioned so that it can be seen by a user, said monitor shows images of a rider on a bike on a road, the images changing according to signals sent from said computer program activated by said handle, and said sensor comprises two circuit boards with a gap therebetween, a plurality of light emitting electronic elements are fixed on said circuit boards to emit light, and a shade plate is positioned between said two circuit boards and moved by a transmitting rod of said handle, said shade plate being separated from said two circuit boards and having a plurality of openings to correspond to said electronic elements, said shade plate being moved with said transmitting rod of said handle when said handle is turned so that shading locations of said electronic elements is varied to form changing signals to be transmitted to said computer program so as to alter images of said rider and said bike shown on said video monitor.

2. The turning control device for a virtual stationary bike as claimed in claim 1, wherein:

said control case comprises an upper cover and a lower cover, said upper cover having a plurality of screw receivers under its bottom surface, said lower cover having a plurality of support rings corresponding to said screw receivers of said upper cover, said two circuit boards having round holes corresponding to said screw receivers of said upper cover, said sensor being placed on said lower cover, said screw receivers passing through said round holes of said upper and said lower circuit boards and screwed to said support rings of said lower cover so that a rotating angle of said shade plate is restricted by a distance between two of said screw receivers of said upper cover.

3. The turning control device for a virtual stationary bike as claimed in claim 1, wherein:

said transmitting rod of said handle is non-circular.

4. The turning control device for a virtual stationary bike as claimed in claim 1, wherein:

said two circuit boards of said sensor each have a through hole to receive a connecting post, said shade plate has a fan-shaped portion and a small size portion with an engaging hole aligned with said through hole of said two circuit boards, so that said connecting post passes through said though holes and said engaging hole to affix said shade plate between but not in contact with said two circuit boards.

5. The turning control device for a virtual stationary bike as claimed in claim 4, wherein:

said connecting post has an upper non-circular recess formed on an upper surface conforming in shape to a non-circular inset recess on said transmitting rod of said handle so as to let said transmitting rod engage and rotate said connecting post and said shade plate synchronously.

6. The turning control device for a virtual stationary bike as claimed in claim 1, wherein said openings of said shade plate are arranged in a plurality of concentric circles, said openings having different sizes and being separated regularly.

7. The turning control device for a virtual stationary bike as claimed in claim 6, wherein said openings of said shade plate are arranged according to Fray's code.

* * * * *